United States Patent [19]

Sato

[11] 4,066,516

[45] Jan. 3, 1978

[54] METHOD FOR FORMING COLORLESS OR COLORED PATTERN HAVING SHADE DIFFERENCE ON AN ALUMINUM OR ALUMINUM ALLOY ARTICLE

[75] Inventor: Toshihiko Sato, Ichikawa, Japan

[73] Assignee: Nippon Light Metal Co., Ltd., Tokyo, Japan

[21] Appl. No.: 695,143

[22] Filed: June 11, 1976

[30] Foreign Application Priority Data

| | | |
|---|---|---|
| June 27, 1975 | Japan | 50-79334 |
| July 15, 1975 | Japan | 50-86280 |
| Nov. 14, 1975 | Japan | 50-136285 |

[51] Int. Cl.[2] ..... C25D 11/04; C25D 11/12; C25D 11/14; C25D 11/22

[52] U.S. Cl. ..... 204/15; 204/18 R; 204/58

[58] Field of Search ..... 204/15, 18 R, 58, 35 N

[56] References Cited

U.S. PATENT DOCUMENTS

| | | | |
|---|---|---|---|
| 2,085,988 | 7/1937 | McNally | 204/18 R |
| 2,540,602 | 2/1951 | Thomas et al. | 204/224 R |
| 3,284,321 | 11/1966 | Fromson | 204/15 |
| 3,450,606 | 6/1969 | Darrow | 204/18 R |
| 3,532,607 | 10/1970 | Roberts | 204/18 R |
| 3,839,163 | 10/1974 | Kaneda | 204/18 R |

*Primary Examiner*—T. M. Tufariello

*Attorney, Agent, or Firm*—Oblon, Fisher, Spivak, McClelland & Maier

[57] ABSTRACT

Colored pattern having shade difference on an aluminum or aluminum alloy article is formed by anodically oxidizing said article in a conventional manner, and applying the anodically oxidized aluminum or aluminum alloy article to a voltage 5–190 V higher than the voltage applied in the anodic oxidation at a portion corresponding to the pattern in an electrolytic bath to increase thickness of barrier layer and then coloring the thus treated article in a solution containing a metal salt.

14 Claims, 9 Drawing Figures

METHOD FOR FORMING COLORLESS OR COLORED PATTERN HAVING SHADE DIFFERENCE ON AN ALUMINUM OR ALUMINUM ALLOY ARTICLE

The present invention relates to a method for forming colorless or colored pattern having shade difference on an aluminum or aluminum alloy article, in which an aluminum or aluminum alloy article is anodically oxidized to form an oxide layer, the aluminum or aluminum alloy article coated with the oxide layer is subjected to electrolysis at a high voltage by using an electrolyte of a high voltage type organic acid or inorganic acid and then, if necessary colored electrolytically.

Heretofore, an anodically oxidized aluminum or aluminum alloy article has been colored by the following processes. Namely, an aluminum alloy article is colored by the alloy component into a unique color. The anodically oxidized aluminum or aluminum alloy article is electrolytically colored by an organic acid. The previously formed anodically oxidized layer is electrolytically colored in a solution containing a metal salt by an alternate current or a direct current. Alternatively, a porous layer of the previously formed anodically oxidized coating is dyed with an organic or inorganic dyestuff.

However, in these processes, the entire aluminum or aluminum alloy article is colored into a common color, and it is substantially impossible to form intentionally a pattern wherein there is gradated color or partially colorless portion.

If such a pattern is to be forcibly formed, an aluminum or aluminum alloy article is once colored into a common color and then a resisting agent or a masking agent is applied in a pattern form and the anodically oxidized of the other portion is removed and then anodically oxidized coating is again formed. Thus, complicated steps are necessary. Furthermore, in such a process, the quality of the anodically oxidized layer partially varies and it is impossible to form a pattern having shade difference.

An object of the present invention is to obviate these defects and to provide a method for forming simply a pattern having two or more colors and shade difference on the anodically oxidized uniform coating without using the resisting agent and the masking agent.

In the present invention, an aluminum or aluminum alloy article is subjected to anodic oxidation in a conventional manner by using an electrolyte of sulfuric acid, phosphoric acid, chromic acid, oxalic acid and other organic acids (Step A) and then the anodically oxidized aluminum or aluminum alloy article is subjected to electrolysis at a portion corresponding to a pattern to be formed by using a high voltage type electrolyte by applying a voltage higher than 5-190 V than the voltage used in the anodic oxidation to increase thickness of barrier layer at the portion applied with the high voltage, whereby a pattern is formed on aluminum or aluminum alloy surface (Step B) and then the thus treated aluminum or aluminum alloy article is subjected to electrolytic coloration in a solution containing a metal salt to form a colored coating, wherein the color and the pattern are partially different (Step C) and, if necessary to treatment for sealing pores on the colored coating is carried out (Step D).

Alternatively, the desired object of the present invention can be attained by changing the order of the step for varying the thickness of barrier layer (Step B) and the step for electrolytically coloring (step C), that is, after the anodic oxidation step (Step A), the anodically oxidized aluminum or aluminum alloy article is subjected to electrolytic coloration (Step C) and then to the treatment for varying the thickness of barrier layer (Step B).

The present invention will be explained in more detail with respect to the treating steps.

A. A step for anodic oxidation:

An aluminum or aluminum alloy article is degreased and, if necessary subjected to etching chemical polishing or electrolytic polishing and then anodically oxidized by using an electrolytic bath of a conventional electrolyte, such as sulfuric acid, phosphoric acid or chromic acid by applying a given voltage corresponding to the electrolyte composition in a conventional manner to form an anodically oxidized coating.

For examples, the conditions in the conventional anodic oxidation are as follows:

| | Concentration (%) | Temperature of electrolytic bath (° C) | Voltage (V) | Time (min.) |
|---|---|---|---|---|
| Aqueous solution of sulfuric acid | 10–25 | 10–25 | 10–30 | 10–60 |
| Aqueous solution of phosphoric acid | 2–20 | 20–50 | 30–120 | 10–90 |
| Aqueous solution of chromic acid | 2–20 | 20–50 | 30–120 | 10–90 |

In this case, when the current in electrolysis is constantly maintained, if the concentration of the electrolytic bath is low and the temperature of the bath is low, the voltage in electrolysis becomes high and such a process is not economic. While if the concentration of the electrolytic bath is high and the temperature of the bath is high, the voltage in electrolysis may be low, but the coating quality is liable to become soft. Accordingly, the above described range is desirable.

B. A step for varying the thickness of barrier layer:

The anodically oxidized aluminum or aluminum alloy article is partially applied to a voltage, which is at least 5 V higher than the voltage applied in the anodic oxidation to form a thick barrier layer at the portion where the higher voltage is applied.

If an aluminum or aluminum alloy article is electrolytically oxidized in various electrolytes as one of the electrodes, the formation voltage varies depending upon the electrolyte. The formation voltage of 10–25% aqueous solution of sulfuric acid or aqueous solution of sulfuric acid added with 0.1% of oxalic acid is 10–30 V, while sulfosalicylic acid, sulfamic acid or malonic acid shows a high voltage of not less than 30 V.

The acid showing the formation voltage of not less than 30 V is referred to as "a high voltage type acid" hereinafter.

Phosphorusmolybdate, boric acid, ammonium borate and phthalic acid need a high voltage. The formed layer is referred to as an active layer, a barrier layer or an insulating layer.

The method of the present invention is characterized by using such high voltage type organic acids or inorganic acids as an electrolyte.

| High voltage type organic acid | used voltage (V) |
|---|---|
| Oxalic acid | 35 - 60 |
| Sulfosalicylic acid | 40 - 70 |
| Phenolsulfonic acid | 40 - 70 |
| Cresolsulfonic acid | 40 - 70 |
| Malonic acid | 80 - 110 |
| Tartaric acid | 120 - 200 |
| Phthalic acid | 100 - 200 |
| Succinic acid | 120 - 200 |
| Maleic acid | 150 - 225 |
| Glycolic acid | 50 - 200 |
| Citric acid | 120 - 200 |
| Malic acid | 50 - 200 |
| Ammonium tartarate | 50 - 200 |
| **High voltage type inorganic acid** | |
| Sulfamic acid | 30 - 40 |
| Boric acid | 30 - 600 |
| Ammonium borate | 30 - 200 |
| Phosphoric acid | 30 - 120 |
| Chromic acid | 30 - 120 |
| Phosphorusmolybdate | 100 - 200 |

The above described acids are used in a concentration of 0.5–100%, preferably 0.5–20%.

The high voltage type organic acids or inorganic acids, when these acids are liquid at room temperature, can be directly used but when these acids are solid powder at room temperature, polyhydric alcohols, clays or water are mixed therewith as a viscosity regulator to obtain a moderate viscosity as an electrolytic bath. The polyhydric alcohol, clay and water to be used as the viscosity regulator can be used in the following compounding.

1. Electrolyte + polyhydric alcohol
2. Electrolyte + clay
3. Electrolyte + water
4. Electrolyte + polyhydric alcohol + clay
5. Electrolyte + polyhydric alcohol + water
6. Electrolyte + clay + water
7. Electrolyte + polyhydric alcohol + clay + water As the polyhydric alcohol, glycerine or sorbitol is preferred.

As clays there are following clay powders consisting mainly of silicic acid, alumina, magnesium and calcium.

Kaolinite ($Al_2O_3.2SiO_2.2H_2O$)
Montmorillonite ($Al_2O_3.4SiO_2.nH_2O$)
Pyrophyllite ($Al_2O_3.4SiO_2.H_2O$)
Bentonite ($Al_2O_3.4SiO_2.nH_2O$)
Sericite ($K_2O.6Al_2O_3.8SiO_2.nH_2O$)
Aluminum silicate ($Al_2O_3.SiO_2$)
Magnesium silicate ($MgO.SiO_2$)
Calcium carbonate ($CaCO_3$)

To at least one of these clays is added water. The viscosity of the electrolytic bath has relation to the thickness of barrier layer to be formed, so that the selection is very important. When the viscosity of the electrolytic bath is low (for example, when a large amount of polyhydric alcohol or water is used), the boundary of pattern becomes unclear and a gradated pattern is formed, while when the viscosity of the electrolytic bath is high (for example, when a large amount of clay is used), a pattern having clear boundary and sharp outline can be obtained.

Voltage condition in electrolysis:

Any one of alternate current and direct current may be used, but the voltage must be at least 5 V higher than the voltage applied in the anodic oxidation (Step A). The range of voltage used is 15–200 V and when the voltage is lower than 15 V, the requirement that the voltage must be 5 V higher than the voltage in the anodic oxidation is not satisfied, while when the voltage is higher than 200 V, the effect does not vary and such a voltage is not economical.

The thickness of the barrier layer is proportional to the voltage in electrolysis and it has been known that in general, a thickness of 10–15 A is formed per 1 V. Accordingly, when the anodic oxidation is effected at 15 V by using sulfuric acid electrolyte, a barrier layer having a thickness of 150–225 A is formed. Then, when a voltage of 60 V is applied by using ammonium borate in the treatment for varying the thickness of barrier layer, a barrier layer having a thickness of 600–900 A is formed and the difference of thickness becomes 450–675 A. As mentioned above, in order to vary the thickness of barrier layer, it is necessary to use an electrolyte to which a voltage of at least 5 V higher than the voltage applied in the anodic oxidation can be applied. Even in the same electrolyte, if the concentration is lowered and the temperature is lowered, a high voltage can be obtained and when the concentration is increased and the temperature is enhanced, the voltage can be decreased, so that the desired voltage can be freely controlled.

The time of voltage applied in electrolysis is from 0.1 second to 5 minutes. When the time is less than 0.1 second, the effect can not be obtained, while when the time is more than 5 minutes, the effect does not vary. The time for applying voltage has no relation to the voltage. The temperature of the electrolytic bath is 5°–40° C and when the temperature is lower, a cooling installtion is necessary, and when the temperature is higher, a heating installation is necessary. In this treatment, a satisfactory effect can be obtained at room temperature.

The larger the difference of voltage applied in the anodic oxidation step (A) from voltage applied in the step (B) for varying the thickness of barrier layer, the larger the contrast in color is. Accordingly, the shade difference of the formed pattern becomes larger.

The process for forming the barrier layer wherein the thickness is partially different, is, for example, as follows:

A roller-shaped electrode provided with the same windows corresponding to a pattern, as when ink is transferred by a printing roller, and housing a sponge-shaped support impregnated with an electrolyte is rolled on an aluminum plane plate (see FIG. 9). Alternatively, an electrode having the same shape as that of a spot welding electrode, which has a proper contacting point or plane and houses a sponge-shaped support impregnated with an electrolyte, is pressed on an aluminum plane plate (see FIG. 2).

When the barrier layer having partially different thickness is formed on an anodically oxidized coating having a uniform thickness, a pattern having shade difference is formed. Then, when the anodically oxidized aluminum or aluminum alloy article having the barrier layer having partially different thickness is subjected to an electrolytic coloring process by using a metal salt (for example, as disclosed in Japanese Pat. No. 310401), a pattern partially different in color is formed and if a transparent protective film is formed on the colored pattern by a clear coating process, a product having a high corrosion resistance can be obtained.

The metal salts capable of being used for the electrolytic coloring process are, for example, nitrates, chlorides, oxalates, acetates, tartarates, chromates, phosphates, of nickel, cobalt, chromium, copper, cadomium, titanium, manganese, molybdenum, calcium, magnesium, vanadium, gold, silver, lead, zinc and so on.

The electrolyte to be used in the electrolytic coloring process is prepared by adding a small amount of the above described metal salts to a solution of a mineral acid, a weak acid or an organic acid (for example, sulfuric acid, oxalic acid, phosphoric acid, chromic acid, sulfamic acid) or a solution of ammonium, amino or imino salt of these acids.

This electrolytic coloring process is carried out by applying an alternate current at 5–75 V at room temperature by using the aluminum or aluminum alloy article treated in the above described steps (A) and (B). When said voltage is less than 5 V, the electric resistance of the alumina coating is large and polarization of the metal ion in the electrolyte is not substantially carried out, while when said voltage is higher than 75 V, the alumina coating is broken and it is impossible to effect coloration.

The coloration in such an electrolytic coloring process is mainly determined by the used metal salt and the light and shade of color is determined by the amount of metal salt deposited. If the electrolytic coloring is repeated several times by changing the metal salt, a synthesized middle color is naturally obtained.

The present invention can provide the above described partially colored pattern and further can be applied to the case when only one side of the plate is to be colored. Furthermore, in Step A → Step B → Step C, when Steps B and C are repeated as follows:

Step A → Step B → Step C → Step B → Step C, more complicated pattern can be obtained.

In addition, in the present invention the following step order can be effected:

Step A → Step C → Step B or

Step A → Step C → Step B → Step C

By the processes the pattern having various colors can be obtained.

The inventor has found that addition of the above described viscosity regulators, such as glycerine and the like to the electrolyte in the step for varying the thickness of the barrier layer can make the pattern more clear. This viscosity regulator can adjust the viscosity of the electrolyte. When glycerine is added to the electrolyte in such an amount that the saturated concentration of glycerine is obtained, the viscosity becomes higher and the boundary of pattern becomes clear and sharp. The concentration of the viscosity regulator can be varied from saturation to 0% depending upon the process for applying the voltage.

The pores on the thus formed colored pattern coating can be sealed by heating the aluminum or aluminum alloy article provided with the colored pattern coating in boiling water for 15–25 minutes.

The present invention will be further explained with reference to the attached drawings.

FIG. 1 shows an enlarged schematic view of an anodically oxidized coating of an aluminum or aluminum alloy article and 1 shows an aluminum or aluminum alloy base, 2 is a barrier layer and 3 is a porous layer. The thickness of the barrier layer 2 is determined by the voltage applied in the anodic oxidation step. FIG. 2 shows a process for varying the thickness of the barrier layer 2, in which into a tubular case 6 made of glass or plastic are inserted an electrode 5 and a sponge 4 impregnated with an electrolyte containing glycerine as a viscosity regulator and such a tubular case 6 is used as one electrode and a voltage of an alternate current or direct current is applied to the electrode 5 and an aluminum plate 1 from an electric source 7. FIG. 3 is a view for explaining the process as shown in FIG. 2 in more detail. By this step only on a portion where a voltage of at least 5 V higher than the voltage applied in the anodic oxidation step is applied, a barrier layer 2′ having a larger thickness is formed. In this case, sharpness of a boundary portion 6′ of the tubular case 6 is determined by the viscosity of the electrolyte impregnated in the sponge 4 and if the viscosity is higher by increasing an amount of glycerine, the electrolyte does not spread from the boundary portion 6′, so that the boundary portion 6′ becomes very clear and a sharply outlined pattern can be formed. When the viscosity of the electrolyte lowers, the boundary portion does not become clear and a sharp gradation can not be obtained and an unclear contour is formed.

Then, when the electrolytic coloring step (Step C) using a metal salt is conducted, the portion applied with the high voltage in the step B, that is, the portion *a* in FIG. 4 is not colored and on the other portion the metal or oxide thereof 9 is deposited and said portion is colored.

If this colored portion is again subjected to the step (Step B) for increasing the thickness of the barrier layer in FIG. 2, the barrier layer at the portion *b* in FIG. 4 becomes the state as shown in the portion *b* in FIG. 5 and then if an additional electrolytic coloring step (Step C) is carried out, the metal is not deposited on the portion *b* while the metal is further deposited on the portion and as a result, a pattern having three colors of deep color portion *c*, light color portion *b* and colorless portion *a* can be formed.

FIG. 6 shows an embodiment for carrying out the method of the present invention in the same manner as mimeographing. An aluminum foil 11 and an aluminum plate 1 are connected to an electric source 7 as both electrodes. On an anodically oxidized coating 3 is mounted a stencil paper 13, wherein a pattern is written and a silk screen 12 is superposed thereon and an electrolyte is coated on the screen and then the aluminum foil 11 is pressed by a roller 10. The voltage is applied only on the pattern portion to the anodically oxidized coating and the thickness of barrier layer varies but the voltage is not applied to the other portion, because the stencil paper is an insulator, so that the thickness of the barrier layer on this portion does not vary. FIG. 7 shows an enlarged schematic view of coloration of pattern in which after the anodic oxidation step (Step A) is effected, the electrolytic coloring step (Step C) is carried out and succeedingly the step (Step B) for varying the thickness of the barrier layer is carried out. In this case, a voltage is applied between a uniformly electrolytically colored aluminum article 1 and an electrode 5. Only the portion applied with the voltage increases the thickness of barrier layer 2′ as shown in portion *a* in FIG. 8 and an amount of metal deposited is decreased and the deepness of color in such a portion varies.

For better understanding of the invention reference is taken to the accompanying drawings, in which.

The invention will be further explained in more detail by the following examples which are not limitative of the invention.

EXAMPLE 1

Figure 1:
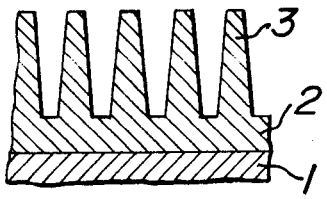
FIG. 1 is an enlarged schematic view of an anodically oxidized coating obtained by Step A.
Figure 2:
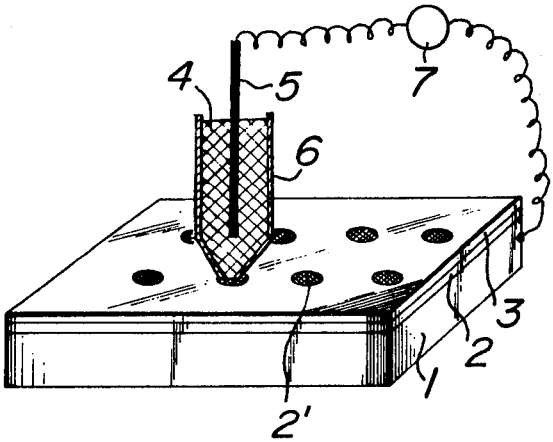
FIG. 2 shows a process for conducting the step (Step B) for varying the thickness of barrier layer of the present invention.
Figure 3:
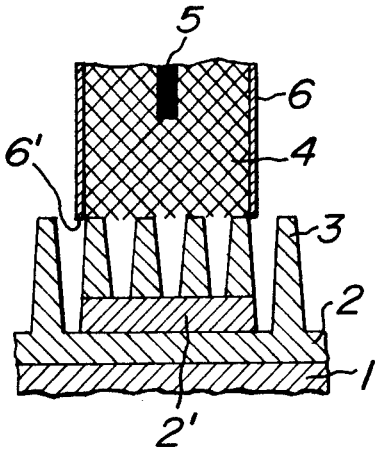
FIG. 3 is an enlarged schematic view showing the process as shown in FIG. 2 in more detail.
Figure 4:
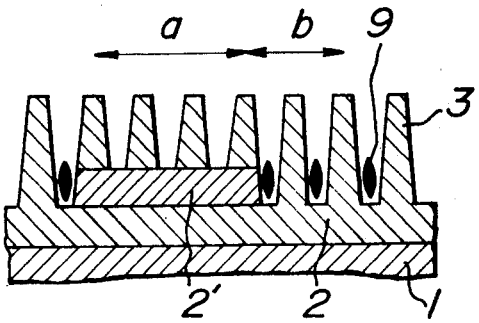
FIG. 4 is an enlarged schematic view showing the state where the metal is deposited in the electrolytic coloring step (Step C)

Aluminum plate (JIS A 1100, pure aluminum of more than 90.00%) was anodically oxidized in 15% aqueous solution of sulfuric acid at 20° C by applying a direct current at 18 V for 20 minutes to form 9 $\mu$ of anodically oxidized coatings. The anodically oxidized aluminum plate was used as anode and another electrode was prepared by inserting a sponge 4 impregnated with a paste-like electrolyte consisting of 5% by weight of tartaric acid, 5% by weight of water and 90% by weight of sorbitol and an electrode 5 in a tubular case 6 as shown in FIG. 2. By using the tubular case 6 the spot pattern was made by applying a direct current at 80 V for 0.5 second. Then, the thus treated aluminum plate was washed with water and then colored in an aqueous solution of a mixture consisting of 3% by weight of nickel sulfate, 3% by weight of boric acid and 94% by weight of water by applying an alternate current at 15 V for 10 minutes to obtain a colored coating having a spot pattern, in which white spots were formed in a bronze color base and the boundary was clear and the contrast was sharp.

EXAMPLE 2

Figure 6:
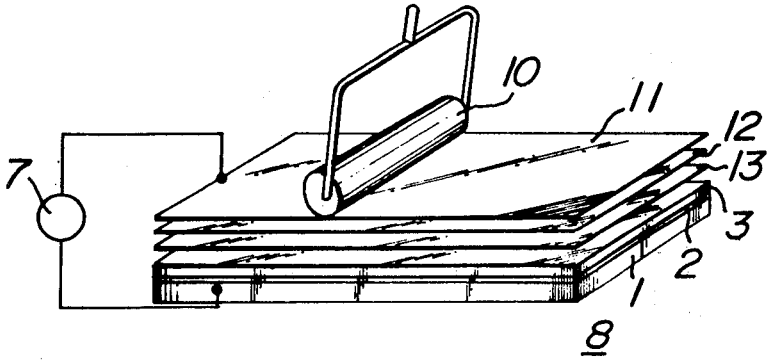
FIG. 6 is a perspective view showing the mimeographing process in the present invention.
Figure 7:
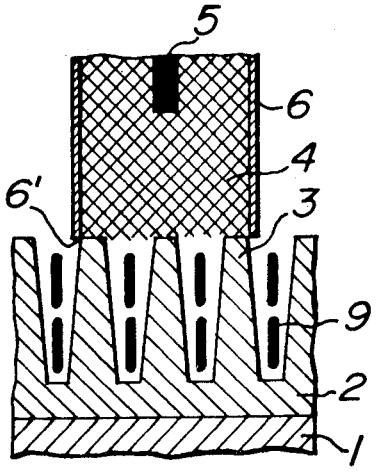
FIG. 7 is an enlarged schematic view when an anodic oxidation step (Step A) is effected and then the electrolytic coloring step (Step C) is carried out, after which the step (Step B) for varying the thickness of barrier layer is carried out.
Figure 8:
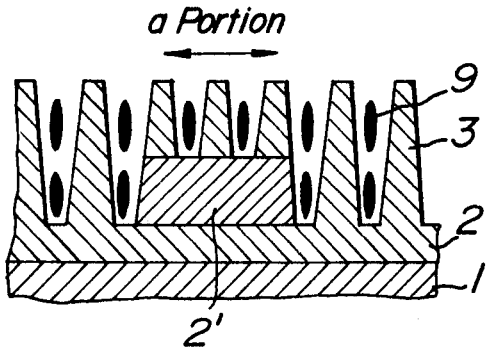
FIG. 8 shows an enlarged schematic view of the state after the process as shown in FIG. 7 has taken place.

An aluminum plate (JIS A 1100 ) as used in Example 1 was anodically oxidized in 5% aqueous solution of phosphoric acid at 30° C by applying a direct current at 30 V for 40 minutes to obtain 6 $\mu$ of anodically oxidized coatings. The anodically oxidized aluminum plate was used as an anode and treated in the same manner as disclosed in FIG. 6. A paste-like mixture consisting of 5% by weight of ammonium borate, 50% by weight of glycerine and 45% by weight of kaolinite was used as the electrolyte to be coated on a screen 12. An aluminum foil 11 was used as a cathode and this aluminum foil was pressed by a roller 10 and an a direct current was applied at 150 for V 60 seconds to form a pattern. Then, the thus treated aluminum plate was washed with water and then colored in an aqueous solution consisting of 3% by weight of nickel sulfate, 3% by weight of boric acid and 94% by weight of water by applying an alternate current at 15 V for 20 minutes to obtain a colored pattern coating in which white portion was formed in a black color plate and the boundary was clear and the contrast was sharp.

EXAMPLE 3

An aluminum plate (JIS A 1100) as used in Example 1 was anodically oxidized in 5% aqueous solution of chromic acid at 30° C by applying a direct current at 40 V for 30 minutes to form 10 $\mu$ of anodically oxidized coatings. The anodically oxidized aluminum plate was used as an anode and another electrode as shown in FIG. 2 was used as a cathode. The sponge 4 was fully impregnated with an electrolyte consisting of 10% by weight of sulfosalicylic acid and 90% by weight of water, the viscosity of which was not substantially varied from the viscosity of water. The electrolysis was effected by applying a direct current at 90 V for 2 seconds and a spot pattern was formed. The thus treated aluminum plate was washed with water and then colored in an aqueous solution consisting of 3% by weight of stannous sulfate, 1% by weight of tartaric acid and 96% by weight of water by applying an alternate current at 10 V for 5 minutes to obtain a colored coating of gradated pattern in which white spots were formed in the light bronze color base and the boundary was not clear.

EXAMPLE 4

An aluminum plate (JIS A 1100) as used in Example 1 was anodically oxidized in 15% aqueous solution of sulfuric acid at 20° C by applying a direct current at 19 V for 30 minutes to obtain 14 $\mu$ of anodically oxidized coatings. The anodically oxidized aluminum plate was used as an anode and treated in the same manner as disclosed in FIG. 6. A paste-like mixture consisting of 3% by weight of oxalic acid, 2% by weight of water and 95% by weight of glycerine was used as the electrolyte and a screen 12 was fully coated with the paste. An aluminum foil 11 was used as a cathode and pressed with a roller 10 and a direct current was applied at 25 V for 1 second to form a pattern. Then the thus treated aluminum plate was washed with water and then colored in an aqueous solution consisting of 4% by weight of copper sulfate, 1.5% by weight of sulfuric acid and 94.5% by weight of water by applying an alternate current at 13 V for 5 minutes to obtain a colored pattern coating in which light reddish-brown portion were formed in deep reddish-brown base and the boundary was not clear and the contrast was not sharp.

EXAMPLE 5

An aluminum plate (JIS A 1100) as sued in Example 1 was anodically oxidized in 15% aqueous solution of sulfuric acid at 20° C by applying a direct current at 19 V for 30 minutes to form 14 $\mu$ of anodically oxidized coatings. The anodically oxidized aluminum plate was used as an anode and treated in the same manner as disclosed in FIG. 6. A paste-like mixture consisting of 3% by weight of oxalic acid, 2% by weight of water and 95% by weight of glycerine was fully coated on a screen 12. An aluminum foil 11 was used as a cathode and the electrolysis was effected by applying a direct current at 80 V for 1 second to form a pattern. Then the thus treated aluminum plate was washed with water and colored in an aqueous solution consisting of 4% by weight of copper sulfate, 1.5% by weight of sulfuric acid and 94.5% by weight of water by applying an alternate current at 13 V for 5 minutes to obtain a colored coating having a gradated pattern in which white portions were formed in deep reddish brown base and the boundary was not clear and the contrast was not sharp.

EXAMPLE 6

An aluminum plate (JIS A 1100) as used in Example 1 was anodically oxidized in 3% aqueous solution of phosphoric acid at 35° C by applying a direct current at 40 V for 40 minutes to obtaine 13 μ of anodically oxidized coatings. The anodically oxidized plate was used as an anode and treated in the same manner as disclosed in FIG. 6. A paste-like mixture consisting of 10% by weight of phosphorusmolybdate, 1% by weight of water and 89% by weight of aluminum silicate was fully coated on a screen 12. An aluminum foil 11 was used as a cathode and the electrolysis was effected by applying a direct current at 50 V for 10 seconds to form a pattern. Then, the thus treated aluminum plate was washed with water and colored in an aqueous solution consisting of 0.5% by weight of silver sulfate, 11.5% by weight of sulfuric acid and 98% by weight of water by applying an alternate current at 10 V for 10 minutes to obtain a colored pattern film in which light gold color portions were formed in deep golden color base and the boundary was clear and the contrast was sharp.

EXAMPLE 7

An aluminum plate (JIS A 1100) as used in Example 1 was anodically oxidized in 15% aqueous solution of sulfuric acid at 20° C by applying a direct current at 18 V for 20 minutes to form 9 μ of anodically oxidized coatings. The anodically oxidized aluminum plate was used as an electrode and electrolytically colored in an aqueous solution consisting of 3% by weight of stannous sulfate, 1% by weight of tartaric acid and 96% by weight of water by applying an alternate current at 15 V for 10 minutes. The thus treated aluminum plate was used as an anode and treated in the same manner as disclosed in FIG. 6 and a paste-like mixture consisting of 5% by weight of boric acid, 1% by weight of water and 94% by weight of magnesium silicate was coated on a screen 12 and an aluminum foil 11 was used as a cathode and the electrolysis was effected by applying a direct current at 25 V for 10 seconds to form a colored coating having pattern in which white portions were formed in deep bronze base and the boundary was clear.

EXAMPLE 8

An aluminum plate (JIS A 1100) as used in Example 1 was anodically oxidized in 15% aqueous solution of sulfuric acid at 20° C by applying a direct current at 18 V for 20 minutes to form 9 μ of anodically oxidized coatings. The anodically oxidized aluminum plate was used as an electrode and electrolytically colored in an aqueous solution consisting of 0.5% by weight of silver sulfate, 1.5% by weight of sulfuric acid and 98% by weight of water by applying an alternate current at 8 V for 15 minutes. Then, the aluminum plate was used as an anode and treated in the same manner as disclosed in FIG. 6. A paste-like mixture consisting of 3% by weight of chromic acid and 97% by weight of glycerine was coated on a screen 12. An aluminum foil 11 was used as a cathode and the electrolysis was effected by applying a direct current at 30 V for 10 seconds to form a pattern. A colored coating in which white portions were formed in deep golden color base and the boundary was not clear, was obtained.

EXAMPLE 9

An aluminum plate (JIS A 1100) as used in Example 1 was anodically oxidized in 5% aqueous solution of chromic acid at 30° C by applying a direct current at 40 V for 30 minutes to form 10 μ of anodically oxidized coatings. The anodically oxidized aluminum plate was used as an electrode and electrolytically colored in an aqueous solution consisting of 4% by weight of copper sulfate, 1.5% by weight of sulfuric acid and 94.5% by weight of water by applying an alternate current at 13 V for 5 minutes. Then, the thus colored aluminum plate was used as an anode and treated in the same manner as disclosed in FIG. 2. The electrolyte consisting of 5% by weight of phenolsulfonic acid and 95% by weight of water was fully impregnated in a sponge 4 and a direct current was applied at 60 V for 60 seconds to form a colored coating having gradated pattern in which white portions were formed in deep reddish brown base and the boundary was not clear.

EXAMPLE 10

An aluminum alloy extruded shape (JIS A 6063, less than 0.1% of Cu, 0.20–0.6% of Si, less than 0.35% of Fe, less than 0.10% of Mn, 0.45–0.9% of Mg, less than 0.10% of Zn, less than 0.10% of Cr, less than 0.10% of Ti, less than 0.15% of the other components and remainder being Al) was anodically oxidized in 5% aqueous solution of chromic acid at 30° C by applying a direct current at 80 V for 50 minutes to form 15 μ of anodically oxidized coatings. The anodically oxidized aluminum alloy was used as an electrode and electrolytically colored in an aqueous solution consisting of 4% by weight of copper sulfate, 1.5% by weight of sulfuric acid and 94.5% by weight of water by applying an alternate current at 13 V for 5 minutes. The thus colored aluminum alloy was used as an electrode and treated in the same manner as disclosed in FIG. 6. A paste-like mixture consisting of 10% by weight of citric acid, 10% by weight of sorbitol and 80% by weight of montmorillonite was coated on a screen 12. An aluminum foil 11 was used as another electrode and the electrolysis was effected by applying an alternate current at 120 V for 5 seconds to form a pattern. A colored coating having pattern in which white portions were formed in deep reddish brown base and the boundary was clear, was obtained.

EXAMPLE 11

An aluminum alloy extruded shape (JIS A 6063) as used in Example 10 was anodically oxidized in 5% aqueous solution of phosphoric acid at 30° by applying a direct current at 36 V for 40 minutes to form 6 μ of anodically oxidized coating. The anodically oxidized aluminum alloy was used as an electrode and electrolytically colored in an aqueous solution consisting of 3% by weight of nickel sulfate, 3% by weight of boric acid and 94% by weight of water by applying an alternate current at 15 V for 20 minutes. The thus colored aluminum alloy was used as an electrode and treated in the same manner as disclosed in FIG. 6. A paste-like mixture consisting of 3% by weight of cresolsulfonic acid, 1% by weight of water and 96% by weight of calcium carbonate was coated on a screen 12. An aluminum foil 11 was used as another electrode and the electrolysis was effected by applying an alternate current at 60 V for 0.5 second to form a pattern. A colored coating having pattern in which bronze portions were formed in black base and the boundary was clear, was obtained.

EXAMPLE 12

An aluminum alloy extruded shape (JIS A 6063) as used in Example 10 was anodically oxidized in 5% by weight of aqueous solution of phosphoric acid at 40° C by applying a direct current at 100 V for 50 minutes to form 15 μ of anodically oxidized coatings. The anodically oxidized aluminum alloy was used an electrode and electrolytically colored in an aqueous solution consisting of 3% by weight of nickel sulfate, 3% by weight of boric acid and 94% by weight of water by applying an alternate current at 30 V for 15 minutes. The thus colored aluminum alloy was used as an electrode and treated in the same manner as disclosed in FIG. 2. A soft solution consisting of 5% by weight of malic acid and 95% by weight of glycerine was fully impregnated in a sponge 4. An alternate current was applied at 200V for 1 second to form a spot pattern. A colored coating having gradated pattern in which white portions were formed in deep blue base.

EXAMPLE 13

An aluminum plate (JIS A 1100) as used in Example 1 was anodically oxidized in 15% aqueous solution of sulfuric acid by applying a direct current at 15 V for 30 minutes to form 9 μ of anodically oxidized coatings (Step 1). The anodically oxidized aluminum plate was used an an anode and treated in the same manner as disclosed in FIG. 2 by applying a direct current at 50 V for 20 seconds to form a spot pattern (Step 2). A sponge 4 was impregnated with a solution of 5% by weight of ammonium borate in 100 c.c. of water. The thus treated aluminum plate was colored in an aqueous solution consisting of 25 g/l of nickel sulfate, 25 g/l of boric acid and 20 g/l of ammonium sulfate by applying an alternate current at 15 V for 3 minutes by using carbon as an opposite electrode (Step 3). The spot pattern portions were not colored and maintained white and the other portions became light bronze pattern but the boundary was not clear.

EXAMPLE 14

Instead of the aqueous solution of ammonium borate used in Step 2 in Example 13, a solution dissolving 5% by weight of ammonium borate in 100 cc of glycerine was used and the aluminum plate (JIS A 1100) was treated in the same manner as described in Example 13. The spot pattern portions were not colored and the other portion was light bronze and the boundary was very clear.

EXAMPLE 15

Figure 5:
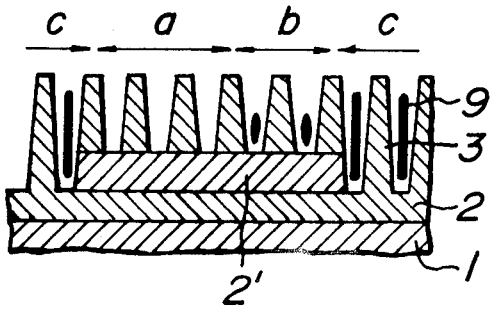
FIG. 5 shows an enlarged schematic view when an additional step (Step B) for varying the thickness of barrier layer is repeated after the electrolytic coloring step as shown in FIG. 4.

On the patterned aluminum plate obtained in Example 14, the spot pattern was formed on the light bronze portion in the same manner as in Step 2 and then treated in the same manner as in Step 3 to form three color pattern as shown in FIG. 5, in which white spot pattern and light bronze color pattern were formed in very deep bronze color. Each boundary was very clear.

EXAMPLE 16

On the anodically oxidized aluminum plate (8 in FIG. 6) obtained in Example 13, a screen 12 sticking a stencil paper 13 wherein letters and symbols were written, was put and an aluminum foil 11 was put thereon and was connected to an electric source 7 of alternate current. Another terminal of the electric source 7 was connected to the aluminum plate 1. A solution dissolving 5% by weight of malonic acid in glycerine was coated on a screen 12. A roller 10 pressed the aluminum foil 11 while applying the alternate current at 75 V. Then, the aluminum plate 8 was electrolytically colored in an aqueous solution consisting of 30 g/l of copper sulfate and 10 g/l of sulfuric acid by applying an alternate current at 10 V for 5 minutes. The letters and symbols written on the stencil paper 13 were formed in white color in reddish brown base and the boundary was clear.

EXAMPLE 17

The stencil paper, in which the grain pattern was written instead of letters and symbols in Example 16, and an aluminum plate, the whole surface of which was uniformly electrolytically colored were used. The same manner as disclosed in Example 16 was effected thereto. A beautiful reddish brown grain pattern wherein there were deep color portion and light color portion, was obtained.

EXAMPLE 18

Figure 9:
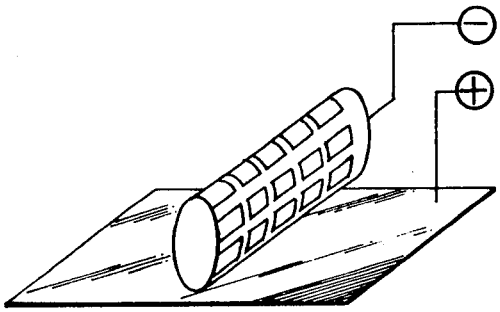
FIG. 9 is a perspective view of a roller type electrode for carrying out the method of the present invention.

An aluminum alloy extruded shape (JIS A 6063) as used in Example 10 was anodically oxidized in 15% aqueous solution of sulfuric acid at 20° C by applying a direct current at 17 V for 30 minutes to form 9 μ of anodically oxidized coating. The anodically oxidized aluminum alloy was used as an anode and subjected to electrolysis in the same manner as disclosed in FIG. 9 by applying a direct current by varying a voltage from 30 to 15 V while rotating a roller through a cloth containing 5% aqueous solution of ammonium borate. Then, the thus treated aluminum alloy was electrolytically colored in an aqueous solution consisting of 10 g/l of stannous sulfate, 5 g/l of sulfuric acid and 20 g/l of tartaric acid by applying an alternate current at 10 V for 10 minutes to form a pattern wherein the color was changed from deep bronze to light bronze.

EXAMPLE 19

An aluminum plate (JIS A 1100) as used in Example 1 was anodically oxidized in 15% aqueous solution of sulfuric acid at 20° C by applying a direct current at 17 V for 30 minutes to form 9 μ of anodically oxidized coatings. On one side of the anodically oxidized aluminum plate, an alternate current was applied at 50 V for 30 seconds through 5% aqueous solution of boric acid. Then, the thus treated aluminum plate was electrolytically colored in an aqueous solution consisting of 25 g/l of nickel sulfate, 25 g/l of boric acid and 20 g/l of ammonium sulfate by applying an alternate current at 20 V for 3 minutes. One side of the aluminum plate was uniformly colored into bronze color, but another side was not colored and formed white surface.

EXAMPLE 20

An aluminum plate (JIS A 1100) as used in Example 1 was anodically oxidized in 15% aqueous solution of sulfuric acid at 20° C by applying a direct current at 17 V to form 9 μ of anodically oxidized coatings. The anodically oxidized aluminum plate was electrolytically colored in an aqueous solution consisting of 25 g/l of nickel sulfate, 25 g/l of boric acid and 20 g/l of ammonium sulfate by applying an alternate current at 15 V for 5 minutes by using carbon as an opposite electrode. The colored aluminum plate was used as an anode and treated in the same manner as disclosed in FIG. 2 by applying a direct current at 20 V for 30 seconds. A sponge 4 was impregnated with 5% aqueous solution of ammonium borate. A spot-like pattern wherein light bronze spots were formed in deep bronze base, was obtained.

EXAMPLE 21

An aluminum alloy extruded shape (JIS A 6063) as used in Example 10 was anodically oxidized in the same manner as disclosed in Example 20 and then electrolytically colored in an aqueous solution consisting of 10 g/l of stannous sulfate, 5 g/l of sulfuric acid and 20 g/l of tartaric acid by applying an alternate current at 10 V for 20 minutes to obtain uniform black color. The thus treated aluminum alloy was used as an anode and subjected to electrolysis in the same manner as disclosed in FIG. 9. As the electrolyte in this electrolysis, 5% aqueous solution of boric acid was used. In this electrolysis the voltage was varied from 30 to 15 V and the roller was slowly rotated. A pattern wherein the color changed from white to light bronze color was formed in black base.

By adding an appropriate concentration of clay, water or polyhydric alcohol to the electrolyte and varying the viscosity, the pattern becomes clear or unclear. The selection can be effected depending upon the object of the pattern, letter, and symbol.

The coloration using a metal salt to be used in the above described step C can be made by any of an alternate current coloration, direct current coloration, pulse wave form coloration and incomplete rectification coloration.

The colored pattern coating according to the method of the present invention does not change, even if ultraviolet ray irradiation was effected for 250 hours by sun shine weather-O-meter and the rating number was 9.5 in 8 hours of CASS test and a high corrosion resistance was obtained.

Furthermore, the aluminum or aluminum alloy having colored pattern formed by the above mentioned processes may be finished by painting in a conventional manner.

What is claimed is:

1. A method of forming a colored pattern on an aluminum or aluminum alloy article which comprises:
   A. anodically oxidizing said article at a voltage of from 10–120 volts;
   B. forming a barrier layer on those areas not to be colored by subjecting said areas to a second anodic oxidation at a voltage of from 15–200 V wherein said voltage is at least 5 volts greater than the voltage applied in Step A; and
   C. electrolytically coloring said article utilizing an electrolytic metal salt bath at a voltage of from 5–75 volts wherein only those areas not subjected to said second anodic oxidation are colored.

2. A method for forming colored pattern having shade difference on an aluminum or aluminum alloy article as claimed in claim 1, wherein the Step B and Step C are repeated two or more times.

3. A method for forming colored pattern having shade difference on an aluminum or aluminum alloy article as claimed in claim 1, wherein at least one of viscosity regulators of a polyhydric alcohol, clay and water is added to the high voltage type organic acid or inorganic acid.

4. A method for forming colored pattern having shade difference on an aluminum or aluminum alloy article as claimed in claim 1, wherein the high voltage type organic acid is oxalic acid, sulfosalicyclic acid, phenolsulfonic acid, cresolsulfonic acid, malonic acid, tartaric acid, phthalic acid, succinic acid, maleic acid, glycolic acid, citric acid or malic acid.

5. A method for forming colored pattern having shade difference on an aluminum or aluminum alloy article as claimed in claim 1, wherein the high voltage type inorganic acid is, sulfamic acid, boric acid, ammonium borate, phosphoric acid, chromic acid or phosphorusmolybdate.

6. A method for forming colored pattern having shade difference on an aluminum or aluminum alloy article as claimed in claim 1, wherein the aluminum or aluminum alloy article having colored pattern is heated in a boiled water for 15–45 minutes to seal pores on the aluminum or aluminum alloy surface.

7. A method for forming colored pattern having shade difference on an aluminum or aluminum alloy article as claimed in claim 1, wherein the aluminum or aluminum alloy article having colored pattern is finished by a conventional painting.

8. A method of forming a colored pattern on an aluminum or an aluminum alloy article which comprises:
   A. anodically oxidizing said article at a voltage of from 10–120 volts;
   B. electrolytically coloring said article utilizing an electrolytic metal salt bath at a voltage of from 5–75 volts, and
   C. forming a barrier layer on those areas wherein the amount of metal deposited by said electrolytic coloring is to be reduced by subjecting said areas to a second anodic oxidation at a voltage of from 15–200 V wherein said voltage is at least 5 volts greater than the voltage applied in Step A.

9. A method for forming colored pattern having shade difference on an aluminum or aluminum alloy article as claimed in claim 8, wherein the Step B and Step C are repeated two or more times.

10. A method for forming colored pattern having shade difference on an aluminum or aluminum alloy article as claimed in claim 8, wherein at least one of viscosity regulators of a polyhydric alcohol, clay and water is added to the high voltage type organic acid or inorganic acid.

11. A method for forming colored pattern having shade difference on an aluminum or aluminum alloy article as claimed in claim 8, wherein the high voltage type organic acid is oxalic acid, sulfosalicylic acid, phenolsulfonic acid, cresolsulfonic acid, malonic acid, tartaric acid, phthalic acid, succinic acid, maleic acid, glycolic acid, citric acid or malic acid.

12. A method for forming colored pattern having shade difference on an aluminum or aluminum alloy article as claimed in claim 8, wherein the high voltage type inorganic acid is sulfamic acid, boric acid, ammonium borate, phosphoric acid, chromic acid or phosphorusmolybdate.

13. A method for forming colored pattern having shade difference on an aluminum or aluminum alloy article as claimed in claim 8, wherein the aluminum or aluminum alloy article having colored pattern is heated in a boiled water for 15–45 minutes to seal pores on the aluminum or aluminum alloy surface.

14. A method for forming colored pattern having shade difference on an aluminum or aluminum alloy article as claimed in claim 8, wherein the aluminum or aluminum alloy article having colored pattern is finished by a conventional painting.

* * * * *